US005184586A

United States Patent [19]

Buchholz

[11] Patent Number: 5,184,586

[45] Date of Patent: Feb. 9, 1993

[54] MECHANICAL COMPRESSION RELEASE FOR AN INTERNAL COMBUSTION ENGINE

[75] Inventor: Brian S. Buchholz, Malone, Wis.

[73] Assignee: Tecumseh Products Company, Tecumseh, Mich.

[21] Appl. No.: 833,348

[22] Filed: Feb. 10, 1992

[51] Int. Cl.[5] ..... F01L 13/08

[52] U.S. Cl. ..... 123/182.1

[58] Field of Search ..... 123/182.1, 90.16

[56] References Cited

U.S. PATENT DOCUMENTS

| | | | |
|---|---|---|---|
| 3,314,408 | 4/1967 | Fenton | 123/182.1 |
| 3,395,689 | 8/1968 | Kruse | 123/182.1 |
| 3,897,768 | 8/1975 | Thiel | 123/182.1 |
| 4,651,687 | 3/1987 | Yamashita et al. | 123/182.1 |
| 4,672,930 | 6/1987 | Sumi | 123/182.1 |
| 4,790,271 | 12/1988 | Onda | 123/182.1 |
| 4,977,868 | 12/1990 | Holschuh | 123/182.1 |

FOREIGN PATENT DOCUMENTS

| | | | |
|---|---|---|---|
| 70492 | 8/1893 | Fed. Rep. of Germany | 123/182.1 |
| 63-201307 | 8/1988 | Japan . | |
| 63-246404 | 10/1988 | Japan | 123/182.1 |

*Primary Examiner*—Andrew M. Dolinar
*Attorney, Agent, or Firm*—Baker & Daniels

[57] ABSTRACT

A compression release mechanism for an internal combustion engine type having a combustion chamber, an intake valve and an intake valve lifter, an exhaust valve and an exhaust valve lifter, and a rotatable camshaft including a camshaft gear and inboard and outboard camshaft lobes fixed thereto. A centrifugally activated movable member is disposed at the outboard side of the outboard camshaft lobe and rotatably engages the camshaft. The movable member includes a slot formed therein and a lifting surface adapted to engage one of the intake or exhaust valve lifters. 104 of A retainer including a guide pin for slidably engaging the movable member is provided at the outboard side of the movable member and rigidly engages the camshaft.

13 Claims, 3 Drawing Sheets

MECHANICAL COMPRESSION RELEASE FOR AN INTERNAL COMBUSTION ENGINE

BACKGROUND OF THE INVENTION

The present invention relates generally to mechanical compression release devices for internal combustion engines and, more particularly, to a device for providing compression relief to the valve located outboard on the camshaft relative to the cam gear.

Compression release mechanisms for internal combustion engines are well known in the art. Generally, these devices are provided to hold one of the valves in the combustion chamber of the cylinder head slightly open during the compression stroke while cranking the engine. This action partially relieves the force of compression in the cylinder during starting, so that starting torque requirements of the engine are greatly reduced. When the engine starts and reaches running speeds, the compression release mechanism is rendered inoperable so that the engine may achieve full performance. It is normally advantageous for the compression release mechanism to be associated with the exhaust valve so that the normal flow of the fuel/air mixture into the chamber through the intake valve, and the elimination of spent gases through the exhaust valve is not interrupted, and the normal direction of flow through the chamber is not reversed. Examples of such compression release mechanisms are disclosed in U.S. Pat. No. 4,977,868 issued to Holschuh and assigned to the assignee of the present invention, the disclosure of which is incorporated herein by reference.

Mechanically operated compression release mechanism disposed outboard of the outboard camshaft lobe which are operable to actuate an exhaust valve are also known in the art. The Holschuh patent discloses a centrifugally activated compression release mechanism having an auxiliary cam surface disposed at the outboard side of the outboard camshaft lobe. The auxiliary cam surface is rigidly attached to a pin which in turn is rotatably carried by an axially aligned bearing passage formed in each of the inboard and outboard lobes. The pin thus extends in a generally axial direction with respect to the camshaft. A flyweight is rigidly attached to the opposite end of the pin between the inboard camshaft lobe and the camshaft gear. A spring causes activation of a compression release valve in response to a stopped or slow engine speed; and centrifugal force imposed on the flyweight causes deactivation of a compression release valve in response to a higher engine speed.

U.S. Pat. No. 3,897,768 to issued to Thiel, also assigned to the assignee of the present invention, discloses a centrifugally activated compression relief mechanism fastened to the camshaft at the outboard side of the outboard camshaft lobe, and uses a plunger which extends through a bore formed in the camshaft.

Compression release mechanisms having a centrifugally activated movable member with slots formed therein for slidably engaging guide pins formed in or attached to conventional engine parts are also known. U.S. Pat. No. 4,651,687, issued to Yamashita, et al., for example, is directed to a compression release device for a four-cycle internal combustion engine. A movable member includes an elliptical and an L-shaped guide slot adapted to slidably engage a pair of pins fixed to the camshaft gear. Spring force causes the yoke to lift a tappet during the compression cycle when starting the engine; and centrifugal force causes the yoke to lie coincident with the camshaft lobe surface when normal engine operation speed is attained. One disadvantage of this apparatus is that it requires a rather complicated guiding arrangement for movement of the yoke In addition, the apparatus requires that the camshaft gear be physically altered and operates to lift only the inboard valve disposed adjacent the camshaft gear.

SUMMARY OF THE INVENTION

The present invention generally provides a mechanically operated compression release mechanism for an internal combustion engine, wherein a centrifugally activated movable member is disposed on the camshaft adjacent the outboard cam lobe and includes a single slot therein, wherein the movable member is axially retained on the camshaft by a retainer that is press fit onto the camshaft and includes an axially extending pin that engages the slot for guiding the movable member between a first position below a threshold speed and a second position above the threshold speed.

More particularly, the present invention provides, in one form thereof, a torsion spring disposed between the movable member and the retainer, wherein one end of the spring is disposed about the movable member and the other end is disposed about the pin. This spring biases the movable member in its first position and further biases the movable member axially along the camshaft against the outboard lobe. The movable member includes a generally elliptical opening which is disposed about the camshaft and permits the movable member to move generally perpendicular to the camshaft.

An advantage of the mechanical compression release device of the present invention is that only three parts are required; thus, reduced manufacturing cost and increased product reliability may be realized.

Another advantage of the mechanical compression release device is that it is adapted to be fastened adjacent the outboard cam lobe without requiring bolts, pins, or other additional fastening devices.

A further advantage of the mechanical compression release device is that neither the camshaft nor camshaft lobes fixed thereto require physical alteration to effect proper operation of the device.

The present invention, in one form thereof, provides an internal combustion engine having a combustion chamber, an intake valve, and an exhaust valve, wherein each of the valves is operable to respectively control the flow of a fuel-air mixture into the combustion chamber and the exhaust of gases therefrom. The intake and exhaust valves include respective intake and exhaust valve lifters. A rotatable camshaft is provided and includes a camshaft gear affixed thereon. Inboard and outboard camshaft lobes are fixed on the camshaft, wherein the inboard lobe is positioned axially on the camshaft between the camshaft gear and the outboard lobe. The lobes are operable to engage respective valve lifters to actuate the intake and exhaust valves. A centrifugally activated moveable member is disposed on the camshaft adjacent the outboard lobe and is revolvable with the camshaft. The movable member includes either a slot or a protruding element and has a lifting surface that extends above the outboard lobe to engage one of the valve lifters when the moveable member is rotated to a first position below a threshold speed. The lifting surface is below the outboard lobe when the movable member is rotated to a second position above the threshold speed. The moveable member is axially retained on the camshaft by a retainer having the other of the slot or pin. The pin is engageable in the slot for guiding the moveable member between the first and second positions.

Alternatively, the invention provides, in one form thereof, an outboard camshaft lobe having a pin member extending outwardly therefrom in a direction away from the camshaft gear. The pin is engageable in the slot of the movable member, and a retainer is provided to retain the movable member on the camshaft.

DETAILED DESCRIPTION OF THE INVENTION

Figure 1:
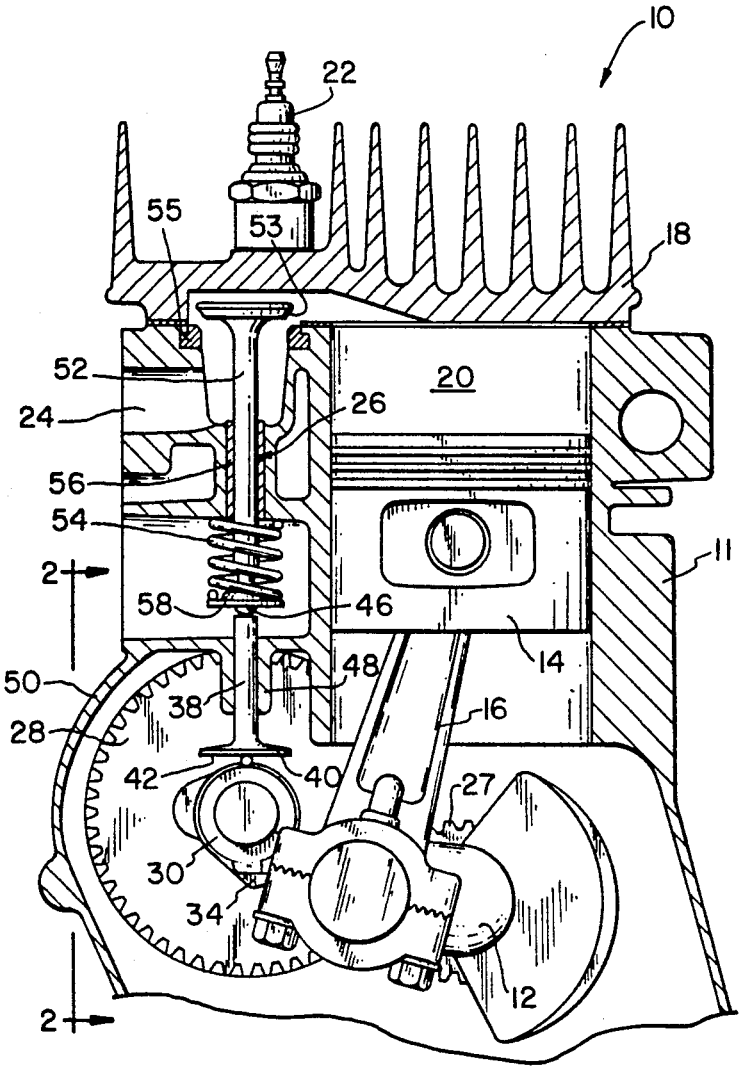
FIG. 1 is a partial vertical sectional view of a single cylinder four-stroke internal combustion engine that incorporates a mechanical compression release device in accordance with the principles of the present invention.

Referring now the drawings and particularly to FIG. 1, there is shown a single cylinder four-stroke internal combustion engine 10 including a compression release mechanism according to one embodiment of the present invention. Although FIG. 1 illustrates a single cylinder four-stroke engine, the invention is not necessarily limited to this particular type of engine. As is customary, the engine shown in FIG. 1 has cylinder 11, crankshaft 12 and piston 14, the piston being operatively connected to crankshaft 12 through connecting rod 16. Piston 14 coacts with cylinder 11 and cylinder head 18 to define combustion chamber 20. Spark plug 22 secured in cylinder head 18 ignites the fuel/air mixture after it has been brought into combustion chamber 20 during the intake stroke and has been compressed during the compression stroke of piston 14. The spark is normally timed to ignite the fuel/air mixture just before piston 14 completes its ascent on the compression stroke. The fuel/air mixture is drawn into combustion chamber 20 from the carburetor of the engine through an intake passage controlled by a conventional intake valve (not shown), and the products of combustion are expelled from the cylinder during the exhaust stroke through exhaust port 24 controlled by poppet-type exhaust valve 26. It is recognized that exhaust valve 26 functions as the compression release valve in a manner to be discussed hereinafter.

Other conventional parts of the valve operating mechanism include timing gear 27 mounted on crankshaft 12 for rotation therewith, and camshaft gear 28 mounted on camshaft 30 and rotatably driven by timing gear 27 to thereby rotate camshaft 30 at one-half crankshaft speed. Camshaft 30 comprises conventional pear-shaped intake and exhaust camshaft lobes 32 and 34, respectively, (FIGS. 2 and 3) which rotate with camshaft 30 to impart reciprocating motion to the intake and exhaust valves via push rods 36 and 38, respectively. In the embodiment shown in the drawings, intake lobe 32 is the inboard lobe adjacent camshaft gear 28, and exhaust lobe 34 is outboard from camshaft gear 28 and lobe 32.

The exhaust valve train is shown in FIG. 1 and includes a tappet 38 which has circular follower 40 with flat underface 42 adapted to bear tangentially against and track upon the periphery 44 of exhaust camshaft lobe 34. Tappet 38 slides in guide boss 48 of crankcase 50, and its upper end pushes against tip 46 of valve 26. In operation, tappet 38 lifts stem 52 which lifts face 53 from valve seat 55. Valve spring 54 encircles stem 52 between valve guide 56 and spring retainer 58. Spring 54 biases valve 26 closed and also biases tappet 38 into tracking contact with exhaust lobe 34.

To aid in starting engine 10, a mechanical compression release device 70 is provided and will be described hereinafter. While device 70 is in its inoperative position, which is designated as the "run" position of the engine, the rotation of outboard lobe 34 with camshaft 30 causes normal operation of valve 26, so that valve 26 opens and closes in timed and periodic relation with the travel of piston 14 according to conventional engine timing practice. Thus, exhaust lobe 34 is adapted to open valve 26 near the end of the power stroke and to hold the same open during ascent of the piston on the exhaust stroke until the piston has moved slightly past top dead center. As camshaft lobe 34 continues to rotate, spring 58 forces tappet 38 downwardly and valve 26 is reseated. Valve 26 is held closed during the ensuing intake, compression and power strokes. Intake camshaft lobe 32 is likewise of conventional fixed configuration to control the intake valve such that it completely closes shortly after the piston begins its compression stroke and remains closed throughout the subsequent power and exhaust strokes, and reopening to admit the fuel mixture on the intake stroke.

Since in a conventional engine, the intake and exhaust valves are normally closed for the major portion of the compression stroke, cranking of the engine would be difficult unless some provision is made to vent combustion chamber 20 during part or all of the compression stroke during cranking of the engine. However, by incorporating the improved compression release mechanism of the present invention, compression relief is automatically obtained at cranking speeds to greatly reduce cranking effort and thereby facilitate starting. Moreover, a conventional engine need not be physically altered to effect compression release with the mechanism of the present invention incorporated therein. The compression release mechanism is responsive to engine speed such that it is automatically rendered inoperative at engine running speeds so that there is no compression loss to decrease the efficiency of the engine when it is running under its own power.

Referring to the drawings, and particularly to FIGS. 2–6, a compression release mechanism 70 of the present invention is shown. Mechanism 70 includes a centrifugally activated moveable member or yoke 72 having a lifting surface 74, an outwardly extending spring engaging hub 76, a single slot 78, outwardly extending tabs 80, and outwardly extending central hub portion 82. Central hub portion 82 is provided with an inside diameter which is larger than the outside diameter of camshaft 30 and is adapted to freely rotate about camshaft 30. Moreover, central hub portion 82 is provide with a slightly elliptical opening (FIGS. 4 and 5) to allow transverse motion of centrifugally activated yoke 72 with respect to camshaft 30. Centrifugally activated yoke 72 is therefore capable of both rotational and transverse movement with respect to camshaft 30.

Lifting surface 74 is provided at an outer surface of yoke 72 and is adapted to engage and lift tappet 38 when engine 10 is in a slowed or stopped condition. Lifting surface 74 may be formed as an integral part of yoke 72 or may be separately formed and rigidly fastened to yoke 72. In a preferred embodiment, yoke 72 is formed using conventional powder metal technology and lifting surface 74, hub 76, tabs 80, and hub 82 are formed therein.

The portion of lifting surface 74 adapted to lift tappet 38 may be provided with an outer surface having a simple or compound curvature maintaining desirable linear acceleration of tappet 38. As shown in FIGS. 3–6, lifting surface 74 has a generally circular cross-section; however, lifting surface 74 may be provided with a different geometry depending on the application of the invention.

Hub 76 is formed at one side of centrifugally activated yoke 72 and is disposed adjacent slot 78. Hub 76 is adapted to engage a formed end 92 of spring 90. Outwardly extending tabs 80 coact with the outwardly extending portions of lifting surface 74, hub 76 nd central hub portion 82 to provide the dual functionality of maintaining yoke 72 a predetermined distance from retainer 84 and providing a conduit for carrying a resilient member.

A resilient member, such as spring 90, includes a formed end 92 for engaging hub 76 and is adapted to provide a radially outward force when in a coiled position. Spring 90 is preferably made of metal having appropriate physical properties. In the embodiment shown, spring 90 is formed to wrap around hub 76. In an alternative embodiment, not shown, formed end 92 of spring 90 may be rigidly fastened or embedded within hub 76.

Retainer 84 has an inner surface 86 with a diameter which is slightly greater than the outside diameter of camshaft 30. A protruding element or guide pin 88 extends outwardly from retainer 84 and slidably engages the slot 78 of yoke 72. Guide pin 88 preferably has a circular cross-section and is integrally formed with retainer 84. Alternatively, guide pin 88 may be separately formed and press fit into a preformed hole in retainer 84.

It is appreciated that, in an alternative embodiment, yoke 72 may be provided with a protruding element, and retainer 84 may be provided with a slot, such that the protruding element of yoke 72 slidably engages the slot of the retainer.

Figure 2:
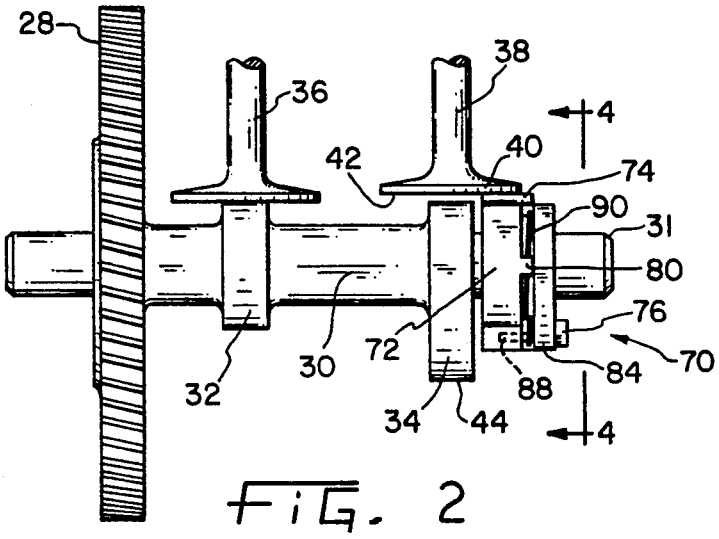
FIG. 2 is an enlarged fragmentary sectional view of the engine of FIG. 1 taken along line 2—2 in FIG. 1.
Figure 3:
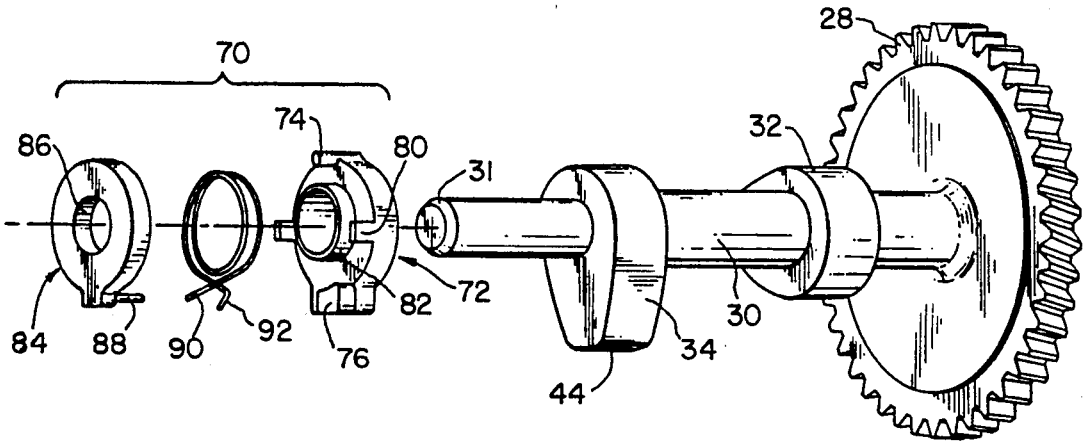
FIG. 3 is an exploded perspective view of the compression release device and associated camshaft, camshaft lobes and camshaft gear of FIG. 1.
Figure 4:
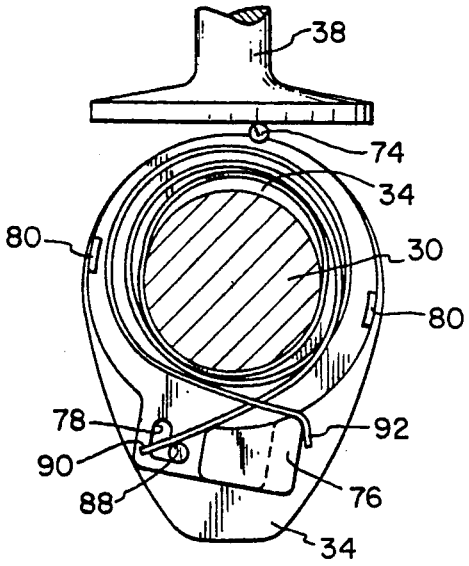
FIG. 4 is an enlarged sectional view taken along line 4—4 in FIG. 2, particularly showing the positional relationship of the compression release device while the engine is operating below a certain threshold speed.
Figure 5:
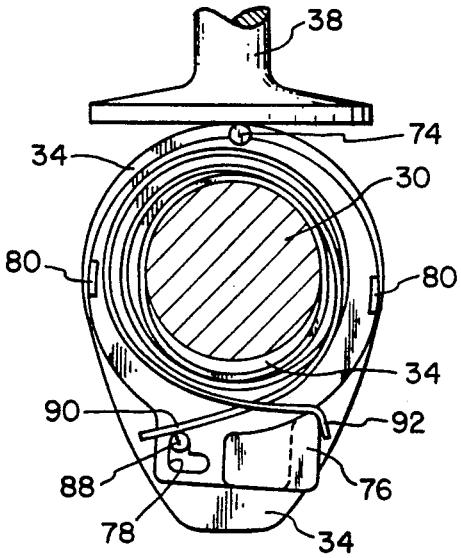
FIG. 5 is a view similar to FIG. 4, except that the device is shown in a second position while the engine is in operation above the threshold speed.
Figure 6:
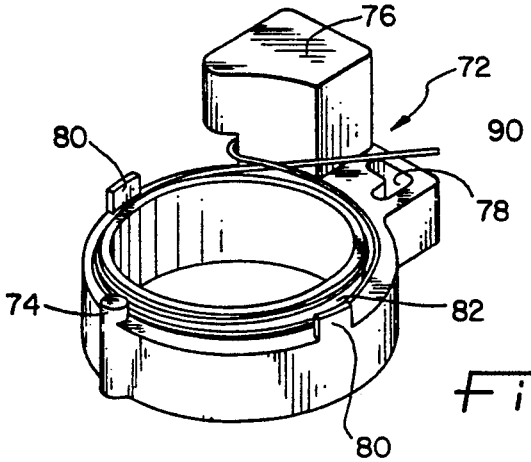
FIG. 6 is an enlarged perspective view of a centrifugally activated movable member in accordance with the principles of the present invention.

Installation of mechanical compression release mechanism 70 onto camshaft 30 may be accomplished as follows: yoke 72 is slid onto camshaft 30 and moved adjacent outboard exhaust camshaft lobe 34 (FIG. 2). Spring 90 is then slid over camshaft 30, and end 92 is positioned to engage hub 76. Spring 90 is wrapped around central hub portion 82 until the opposite end of spring 90 is disposed adjacent formed end 92 (FIGS. 4 and 5). Retainer 84 is then press fit onto camshaft 30 and positioned so that guide pin 88 slidably engages slot 78. Camshaft 30 may optionally be provided with a chamfered end 31 (FIG. 3) to facilitate press fitting of retainer 84 thereon. Thus, yoke 72, spring 90 and retainer 84 form an integral assembly comprising the mechanical compression release mechanism 70. Alternatively, spring 90 may be attached to yoke 72 as shown in FIG. 6. Then the yoke and spring assembly is slid over camshaft 30 followed by retainer 84. Yet another alternative includes attaching retainer 84 to yoke 72 such that the entire mechanism forms an integral assembly, and the entire assembly is then press fit onto camshaft 30.

FIG. 4 depicts mechanical compression release 70 while engine 10 is in a slowed or stopped operating condition. Spring 90 causes yoke 72 to move to a first position whereby lifting surface 74 engages and lifts tappet 38. More particularly, camshaft 30 is in a slowed or stopped operating condition and therefore is exerting little or no rotational and centrifugal force on yoke 72. Spring 90 causes guide pin 88 to move to the position shown in FIG. 4, and lifting surface 74 is caused to extend outwardly from the outer surface of outboard lobe 34. Valve 26 is thereby moved slightly upwardly (FIGS. 1 and 4) to relieve pressure within combustion chamber 20 during the compression cycle.

As engine speed and rotational speed of camshaft 30 increases, rotational and centrifugal forces acting on yoke 72 also increase. At a predetermined level, rotational forces acting on yoke 72 overcome forces imparted by spring 90, and yoke 72 rotates counterclockwise with respect to the relative position of camshaft 30 (FIG. 5). Centrifugal forces then cause yoke 72 to move radially outwardly to the position shown in FIG. 5, whereby guide pin 88 is positioned at the opposite end of L-shaped slot 78. Lifting surface 74 accordingly moves radially inwardly toward camshaft 30, and the pushrod engaging portion of lifting surface 74 is positioned coincident with the outer surface of cam lobe 34. Lifting surface 74 therefore does not lift tappet 38 during the compression cycle, and poppet-type exhaust valve 26 is allowed to move to a completely seated position.

Figure 7:
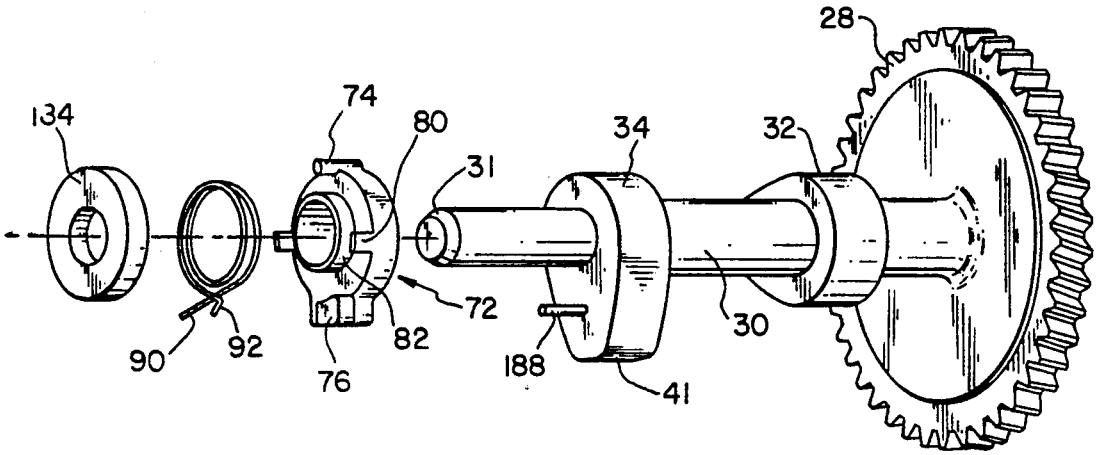
FIG. 7 is an exploded perspective view of an alternative embodiment of a compression release device and associated camshaft, camshaft lobes and camshaft gear.
Figure 8:
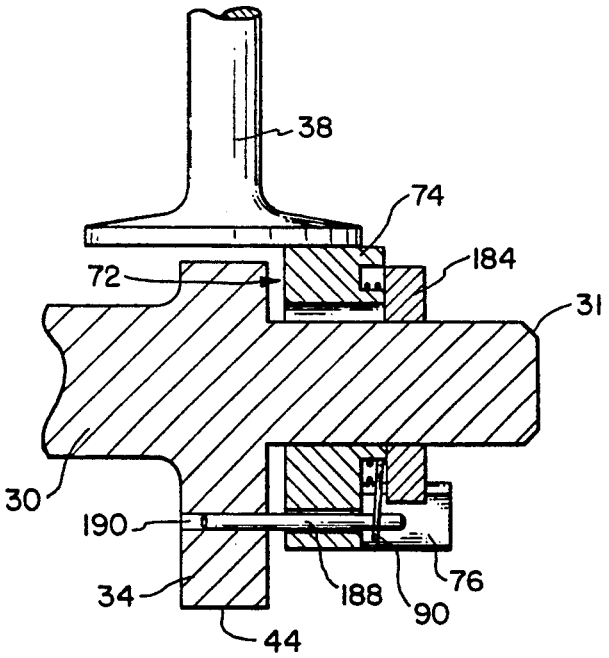
FIG. 8 is an enlarged sectional assembled view of the compression release device of FIG. 7.

An alternative embodiment is shown in FIGS. 7–8, wherein lobe 34 includes a guide pin 188 extending therefrom. As shown in FIG. 8, pin 188 may be press fit into opening 190 or, alternatively, may be formed integrally therewith. In this arrangement, pin 188 extends into slot 78 from the opposite side of yoke 72 as does pin 88. As illustrated, retainer 184 is in the shape of a ring member that is press fit onto camshaft 30 to retain the assembly.

It will be appreciated that the foregoing is presented by way of illustration only, and not by way of any limitation, and that various alternatives and modifications may be made to the illustrated embodiment without departing from the spirit and scope of the invention.

What is claimed is:

1. An internal combustion engine, comprising:

a combustion chamber;

an intake valve and an exhaust valve, each operable to respectively control the flow of a fuel/air mixture into the combustion chamber and the exhaust of gases therefrom, said intake and exhaust valves including respective intake and exhaust valve lifters;

a rotatable camshaft having a camshaft gear affixed thereon;

inboard and outboard camshaft lobes fixed on said camshaft, said inboard lobe being positioned axially on said camshaft between said camshaft gear and said outboard lobe, said camshaft lobes being operable to engage respective valve lifters to actuate said intake and exhaust valves;

a centrifugally activated movable member disposed on said camshaft adjacent said outboard lobe and being revolvable with said camshaft, said movable member including one of a slot and a protruding element, said movable member further including a lifting surface that extends above said outboard lobe to engage one of said valve lifters when said movable member is rotated to a first position below a threshold speed, said lifting surface being below said outboard lobe when said movable member is rotated to a second position above said threshold speed; and a retainer for axially retaining said moveable member on said camshaft, said retainer including the other of said slot and said protruding element, wherein said protruding element is engageable in said slot for guiding said movable member between said first and second positions.

2. The engine of claim 1, wherein said retainer is press fit onto said camshaft and is rotatable therewith.

3. The engine of claim 1, including resilient means for biasing said movable member in said first position, said bias means being disposed on said camshaft.

4. The engine of claim 3, wherein said bias means comprises a generally helical spring having a first end disposed about said protruding element and a second end disposed about said movable member.

5. The engine of claim 4, wherein said movable member includes a weighted portion for overcoming the bias of said spring while the engine is operating above said threshold speed.

6. The engine of claim 5, wherein said second end of said spring is disposed about said weighted portion.

7. The engine of claim 1, wherein said movable member includes a generally elliptical opening which receives said camshaft, said elliptical opening permitting said movable member to move generally perpendicular to a central axis through said camshaft.

8. The engine of claim 1, wherein said slot is generally L-shaped and has a first end that is generally normal to said second end.

9. The engine of claim 8, wherein said spring biases said first end in engagement with said protruding element while said movable member is in said first position.

10. The engine of claim 8, wherein said second end is engagement with said protruding element while said movable member is in said second position.

11. An internal combustion engine comprising:

a combustion chamber;

an intake valve and an exhaust valve, each operable to respectively control the flow of a fuel/air mixture into the combustion chamber and the exhaust of gases therefrom, said intake and exhaust valves including respective intake and exhaust valve lifters;

a rotatable camshaft having a camshaft gear affixed thereon;

inboard and outboard camshaft lobes fixed on said camshaft, said inboard lobe being positioned axially on said camshaft between said camshaft gear and said outboard lobe, said camshaft lobes being operable to engage respective valve lifters to actuate said intake and exhaust valves, said outboard camshaft lobe including a pin member extending outwardly from said outboard lobe in a direction away from said camshaft gear;

a centrifugally activated movable member disposed on said camshaft adjacent said outboard lobe and being revolvable with said camshaft, said movable member including a slot therein and a lifting surface that extends above said outboard lobe to engage one of said valve lifters when said movable member is rotated to a first position below a threshold speed, said lifting surface being below said outboard lobe when said movable member is rotated to a second position above said threshold speed, said pin engageable in said slot for guiding said movable member between said first and second positions; and means for retaining said movable member on said camshaft.

12. The engine of claim 11, wherein said retainer means is press fit onto said camshaft and is rotatable therewith.

13. An internal combustion engine, comprising:

a combustion chamber;

an intake valve and an exhaust valve, each operable to respectively control the flow of a fuel/air mixture into the combustion chamber and the exhaust of gases therefrom, said intake and exhaust valves including respective intake and exhaust valve lifters;

a rotatable camshaft having a camshaft gear affixed thereon;

inboard and outboard camshaft lobes fixed on said camshaft, said inboard lobe being positioned axially on said camshaft between said camshaft gear and said outboard lobe, said camshaft lobes being operable to engage respective valve lifters to actuate said intake and exhaust valves;

a centrifugally activated movable member disposed on said camshaft adjacent said outboard lobe and being revolvable with said camshaft, said movable member including one of a slot and a protruding element, said movable member further including a lifting surface that extends above said outboard lobe to engage one of said valve lifters when said movable member is rotated to a first position below a threshold speed, said lifting surface being below said outboard lobe when said movable member is rotated to a second position above said threshold speed; and a retainer for axially retaining said moveable member on said camshaft, one of said retainer and said outboard lobe including the other of said slot and said protruding element, wherein said protruding element is engageable in said slot for guiding said movable member between said first and second positions.

* * * * *